US009816260B1

(12) United States Patent
Kindinger

(10) Patent No.: US 9,816,260 B1
(45) Date of Patent: Nov. 14, 2017

(54) TOILET FLUSHING DEVICE

(71) Applicant: Terry Kindinger, Defiance, OH (US)

(72) Inventor: Terry Kindinger, Defiance, OH (US)

( * ) Notice: Subject to any disclaimer, the term of this patent is extended or adjusted under 35 U.S.C. 154(b) by 0 days.

(21) Appl. No.: 15/179,613

(22) Filed: Jun. 10, 2016

(51) Int. Cl.

| | |
|---|---|
| ***E03D 5/00*** | (2006.01) |
| ***E03D 5/092*** | (2006.01) |
| ***F16H 21/44*** | (2006.01) |
| ***F16H 37/12*** | (2006.01) |
| ***F16H 19/04*** | (2006.01) |

(52) U.S. Cl.
CPC ..... *E03D 5/092* (2013.01); *F16H 19/04* (2013.01); *F16H 21/44* (2013.01); *F16H 37/12* (2013.01)

(58) Field of Classification Search
CPC ..... E03D 5/092
USPC ..... 4/249
See application file for complete search history.

(56) References Cited

U.S. PATENT DOCUMENTS 2,908,915 A 10/1959 Holl
5,056,165 A * 10/1991 Wescott, Sr. ..... E03D 5/08 4/246.1
5,068,925 A * 12/1991 Salibi ..... E03D 5/08 4/249
5,142,708 A 9/1992 Johnson et al.
5,170,513 A 12/1992 Ambooken et al.
5,339,468 A * 8/1994 Lin ..... E03D 5/08 4/246.5
6,718,562 B1 * 4/2004 Saragas ..... E03D 5/08 4/249
8,214,933 B1 * 7/2012 Gaudin ..... A47K 13/10 4/246.1
8,286,273 B1 * 10/2012 Toomer ..... E03D 5/08 242/389

* cited by examiner

*Primary Examiner* — Huyen Le
(74) *Attorney, Agent, or Firm* — Stevenson IP, LLC

(57) ABSTRACT

A toilet flushing device including a pivot support member attached to an exterior surface of a bowl of a toilet. A lever arm has a pivot member hingedly attached to the pivot support member. A substantially triangulated handle has a back edge medially attached to a front end of the lever arm. A rubberized stopper member is attached to the exterior surface of the bowl of the toilet. A bottom end of a rod is pivotably attached to a back end of the lever arm, and a top end of the rod is extended upwards along a side of a tank of the toilet. A flush valve actuator has a rack gear disposed on the rod and a pinion gear disposed adjacent to the side of the tank. The pinion gear is connected to a flushing mechanism disposed within the tank.

2 Claims, 4 Drawing Sheets

TOILET FLUSHING DEVICE

BACKGROUND OF THE INVENTION

Various types of toilet flushers are known in the prior art. However, what has been needed is a toilet flushing device including a pivot support member attached to an exterior surface of a bowl of a toilet, a lever arm having a pivot member hingedly attached to the pivot support member, a substantially triangulated handle having a back edge medially attached to a front end of the lever arm, and a rubberized stopper member attached to the exterior surface of the bowl of the toilet. What has been further needed is a bottom end of a rod pivotably attached to a back end of the lever arm, and a top end of the rod extended upwards along a side of a tank of the toilet. Lastly, what has been needed is a flush valve actuator having a rack gear disposed on the rod and a pinion gear disposed adjacent to the side of the tank, with the pinion gear connected to a flushing mechanism disposed within the tank. Since the handle is disposed approximately three-quarters of a length of the bowl of the toilet from a rear side, the handle can be easily depressed by a user while the user is sitting on the toilet. This eliminates the need for a user to bend over and strain to reach the flush lever disposed proximal a top end of the tank. The toilet flushing device is thus ideally suited for those users with physically disabilities or arthritis, since the toilet can be easily flushed without the potential for falls or strains.

FIELD OF THE INVENTION

The present invention relates to toilet flushers, and more particularly, to a toilet flushing device.

SUMMARY OF THE INVENTION

The general purpose of the present toilet flushing device, described subsequently in greater detail, is to provide a toilet flushing device which has many novel features that result in a toilet flushing device which is not anticipated, rendered obvious, suggested, or even implied by prior art, either alone or in combination thereof.

To accomplish this, the present toilet flushing device includes a cylindrical pivot support member attached to an exterior surface of a bowl of a toilet proximal a rear side of the bowl. The pivot support member is extended horizontally outward from the bowl. A lever arm has a front end, a back end, and a cylindrical pivot member disposed approximately one-quarter of a length of the lever arm from the back end. The pivot member of the lever arm is hingedly attached to an outer side of the pivot support member, and the back end is extended rearwardly from the rear side of the bowl of the toilet. A circumference of the pivot member of the lever arm is equal to a circumference of the pivot support member. A substantially triangulated handle has a rectangular front edge, a rectangular back edge, a rectangular top side, a rectangular bottom side, a triangular right side, and a triangular left side. The back edge is medially attached to the front end of the lever arm, and the handle is disposed approximately three-quarters of a length of the bowl of the toilet from the rear side. A rubberized stopper member is attached to the exterior surface of the bowl of the toilet approximately one-half of the length of the bowl of the toilet from the rear side. The stopper member is diagonally disposed above the pivot support member.

The toilet flushing device further includes a substantially vertically disposed rod having a bottom end and a top end.

The bottom end of the rod is pivotably attached to the back end of the lever arm and the top end is extended upwards along a side of a tank of the toilet and disposed proximal a top area of the tank. A flush valve actuator has a rack gear disposed on the rod proximal the top end and a pinion gear disposed immediately adjacent to the side of the tank of the toilet proximal the top area of the tank. The pinion gear rotatably engages a plurality of teeth disposed on the rack gear, with the pinion gear rotatably connected to a flushing mechanism disposed within the tank of the toilet and extended outwards through an aperture on the side of the tank. The flushing mechanism includes those commonly known in the art.

The handle has a downwardly depressed position and an alternate upwardly extended position. The handle is in the downwardly depressed position when a gap is disposed between the stopper member and the lever arm. The handle is in the alternate upwardly extended position when the rod is disposed immediately underneath and against the stopper member. The downwardly depressed position is configured to activate the flushing mechanism using the flush valve actuator in order to flush the toilet. A rubberized covering is optionally disposed on an entirety of the top side of the handle for ease of grip.

Thus has been broadly outlined the more important features of the present toilet flushing device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
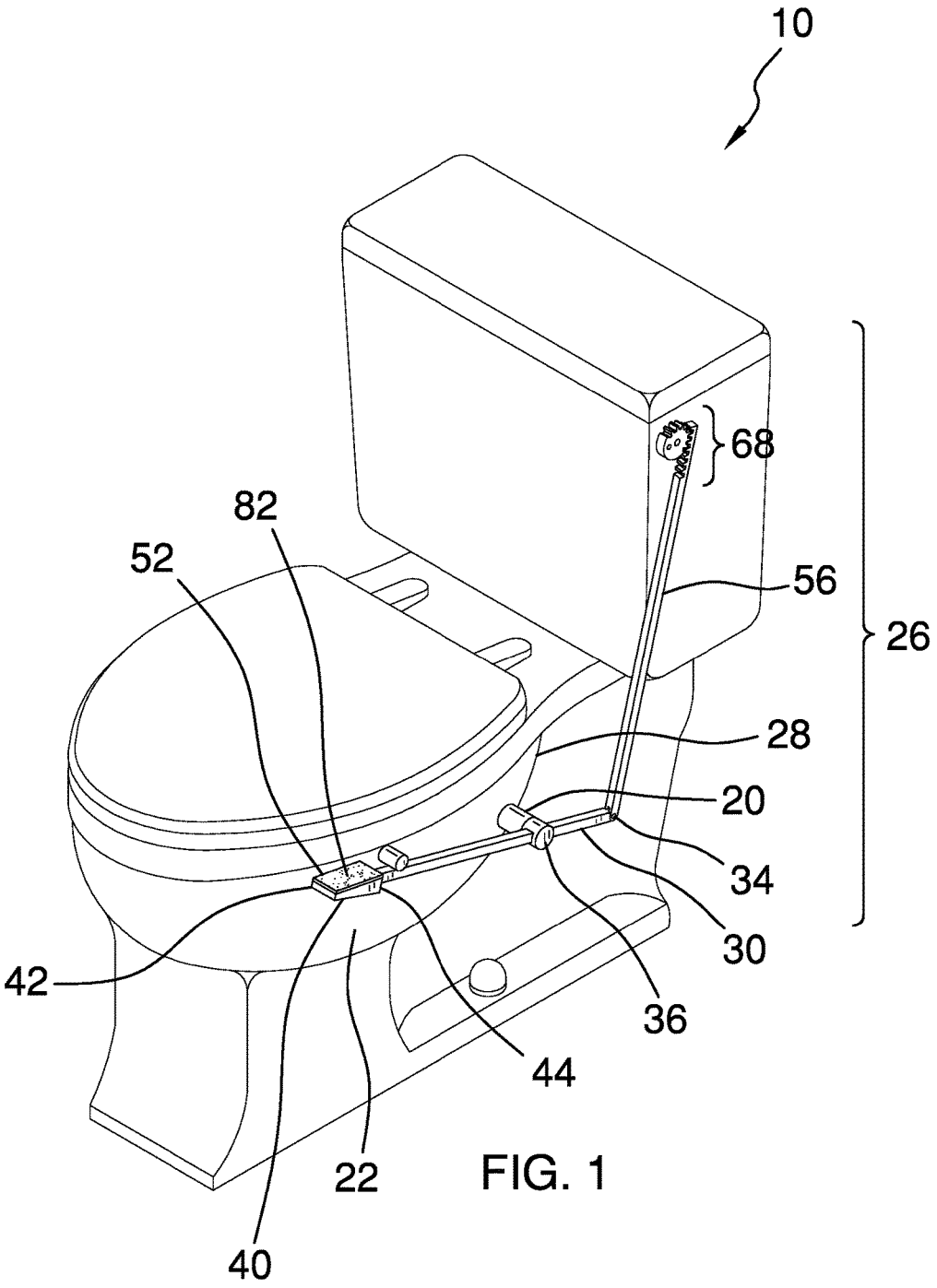
FIG. 1 is a front isometric view.
Figure 2:
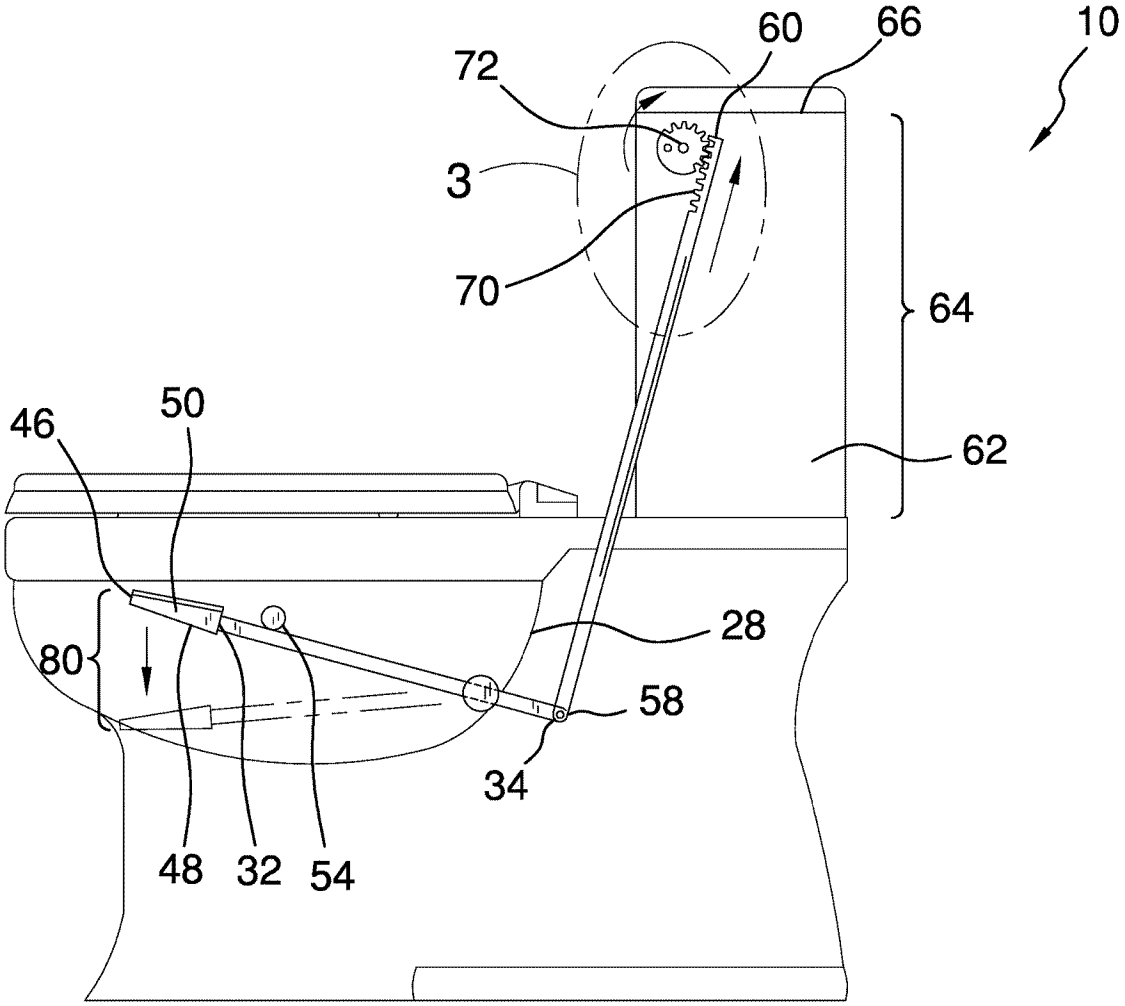
FIG. 2 is a side elevation view.
Figure 4:
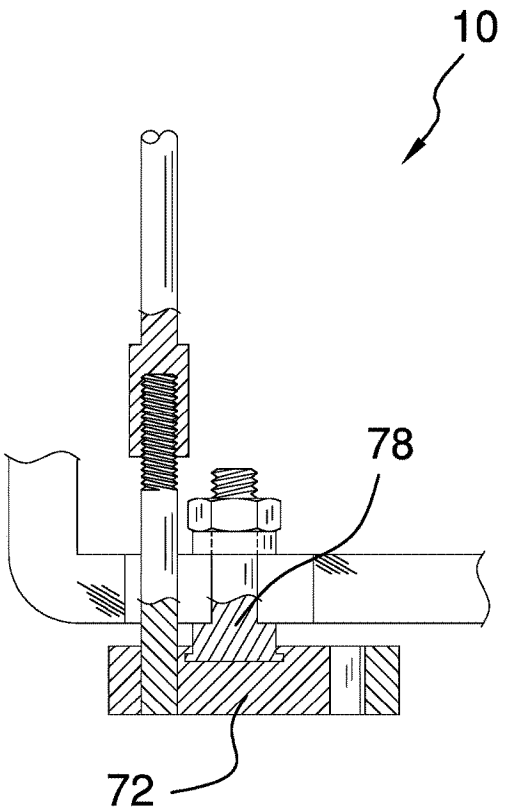
FIG. 4 is a cross-sectional view taken along line 4-4 of FIG. 3.
Figure 3:
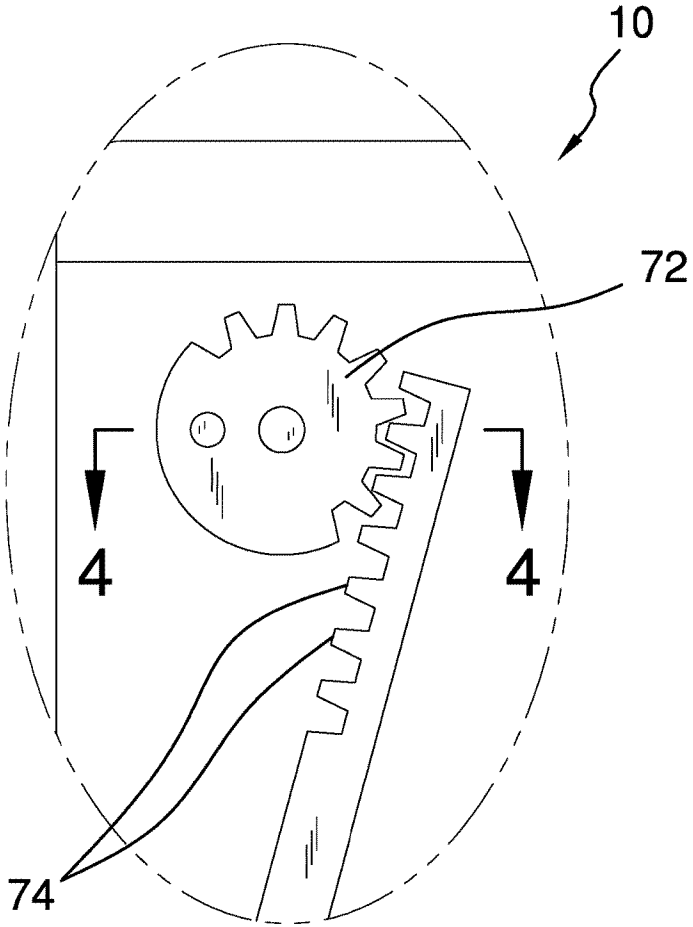
FIG. 3 is a detail view showing a flush valve actuator.
Figure 5:
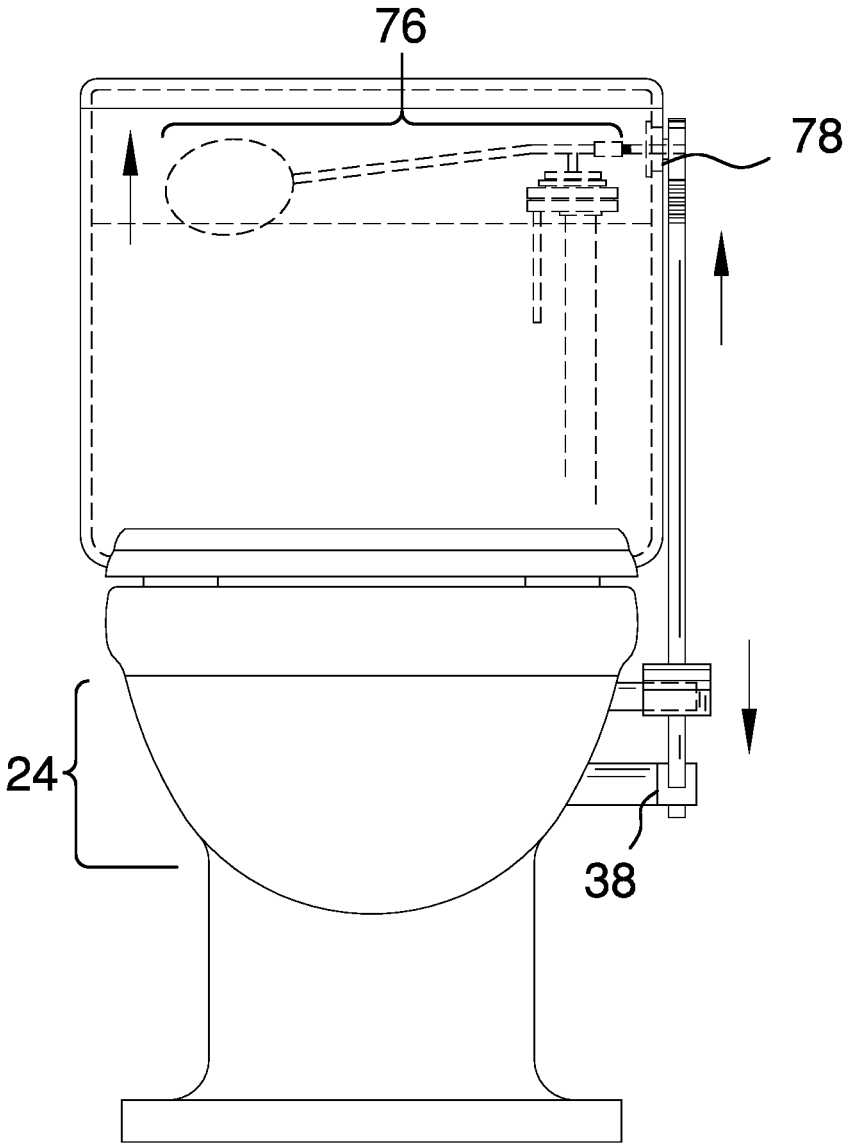
FIG. 5 is a front elevation view.

With reference now to the drawings, and in particular FIGS. 1 through 5 thereof, an example of the instant toilet flushing device employing the principles and concepts of the present toilet flushing device and generally designated by the reference number 10 will be described.

Referring to FIGS. 1 through 5 the present toilet flushing device 10 is illustrated. The toilet flushing device 10 includes a cylindrical pivot support member 20 attached to an exterior surface 22 of a bowl 24 of a toilet 26 proximal a rear side 28 of the bowl 24. The pivot support member 20 is extended horizontally outward from the bowl 24. A lever arm 30 has a front end 32, a back end 34, and a cylindrical pivot member 36 disposed approximately one-quarter of a length of the lever arm 30 from the back end 34. The pivot member 36 of the lever arm 30 is hingedly attached to an outer side 38 of the pivot support member 20, and the back end 34 is extended rearwardly from the rear side 28 of the bowl 24 of the toilet 26. A circumference of the pivot member 36 of the lever arm 30 is equal to a circumference of the pivot support member 20. A substantially triangulated handle 40 has a rectangular front edge 42, a rectangular back edge 44, a rectangular top side 46, a rectangular bottom side 48, a triangular right side 50, and a triangular left side 52. The back edge 44 is medially attached to the front end 32 of the lever arm 30, and the handle 40 is disposed approximately three-quarters of a length of the bowl 24 of the toilet 26 from the rear side 28. A rubberized stopper member 54 is attached to the exterior surface 22 of the bowl 24 of the toilet 26 approximately one-half of the length of the bowl 24 of the toilet 26 from the rear side 28. The stopper member 54 is diagonally disposed above the pivot support member 20.

The toilet flushing device 10 further includes a substantially vertically disposed rod 56 having a bottom end 58 and a top end 60. The bottom end 58 of the rod 56 is pivotably attached to the back end 34 of the lever arm 30 and the top end 60 is extended upwards along a side 62 of a tank 64 of the toilet 26 and disposed proximal a top area 66 of the tank 64. A flush valve actuator 68 has a rack gear 70 disposed on the rod 56 proximal the top end 60 and a pinion gear 72 disposed immediately adjacent to the side 62 of the tank 64 of the toilet 26 proximal the top area 66 of the tank 64. The pinion gear 72 rotatably engages a plurality of teeth 74 disposed on the rack gear 70, with the pinion gear 72 rotatably connected to a flushing mechanism 76 disposed within the tank 64 of the toilet 26 and extended outwards through an aperture 78 on the side of the tank 64.

The handle 40 has a downwardly depressed position and an alternate upwardly extended position. The handle 40 is in the downwardly depressed position when a gap 80 is disposed between the stopper member 54 and the lever arm 30. The handle 40 is in the alternate upwardly extended position when the rod 56 is disposed immediately underneath and against the stopper member 54. The downwardly depressed position is configured to activate the flushing mechanism 76 using the flush valve actuator 68 in order to flush the toilet 26. A rubberized covering 82 is optionally disposed on an entirety of the top side 46 of the handle 40.

What is claimed is:

1. A toilet flushing device comprising:

a cylindrical pivot support member attached to an exterior surface of a bowl of a toilet proximal a rear side of the bowl, the pivot support member extended horizontally outward from the bowl;

a lever arm having a front end, a back end, and a cylindrical pivot member disposed approximately one-quarter of a length of the lever arm from the back end, wherein the pivot member of the lever arm is hingedly attached to an outer side of the pivot support member, wherein the back end is extended rearwardly from the rear side of the bowl of the toilet;

wherein a circumference of the pivot member of the lever arm is equal to a circumference of the pivot support member;

a substantially triangulated handle having a rectangular front edge, a rectangular back edge, a rectangular top side, a rectangular bottom side, a triangular right side, and a triangular left side, wherein the back edge is medially attached to the front end of the lever arm, wherein the handle is disposed approximately three-quarters of a length of the bowl of the toilet from the rear side;

a rubberized stopper member attached to the exterior surface of the bowl of the toilet approximately one-half of the length of the bowl of the toilet from the rear side, wherein the stopper member is diagonally disposed above the pivot support member;

a substantially vertically disposed rod having a bottom end and a top end, the bottom end pivotably attached to the back end of the lever arm and the top end extended upwards along a side of a tank of the toilet and disposed proximal a top area of the tank; and a flush valve actuator having a rack gear disposed on the rod proximal the top end and a pinion gear disposed immediately adjacent to the side of the tank of the toilet proximal the top area of the tank, wherein the pinion gear rotatably engages a plurality of teeth disposed on the rack gear, wherein the pinion gear is rotatably connected to a flushing mechanism disposed within the tank of the toilet and extended outwards through an aperture on the side of the tank;

wherein the handle has a downwardly depressed position and an alternate upwardly extended position;

wherein the handle is in the downwardly depressed position when a gap is disposed between the stopper member and the lever arm;

wherein the handle is in the alternate upwardly extended position when the rod is disposed immediately underneath and against the stopper member;

wherein the downwardly depressed position is configured to activate the flushing mechanism using the flush valve actuator in order to flush the toilet.

2. The toilet flushing device of claim 1 further comprising a rubberized covering disposed on an entirety of the top side of the handle.

* * * * *